US005272956A

United States Patent [19]

Hudson

[11] Patent Number: 5,272,956

[45] Date of Patent: Dec. 28, 1993

[54] RECOIL GAS SYSTEM FOR RIFLE

[76] Inventor: Lee C. Hudson, 1431 W. Behrend Dr., Phoenix, Ariz. 85027

[21] Appl. No.: 896,813

[22] Filed: Jun. 11, 1992

[51] Int. Cl.[5] ..... F41A 5/28

[52] U.S. Cl. ..... 89/128; 42/72; 89/193

[58] Field of Search ..... 42/72, 73; 89/128, 191.01, 89/193

[56] References Cited

U.S. PATENT DOCUMENTS

| | | | |
|---|---|---|---|
| 1,042,363 | 10/1912 | McClean | 89/128 |
| 1,293,396 | 2/1919 | Fox | 89/193 |
| 1,315,215 | 9/1919 | Davidson | 42/72 |
| 1,802,816 | 4/1931 | Holek | 89/193 |
| 3,369,316 | 2/1968 | Miller | 42/73 |
| 3,675,534 | 7/1972 | Beretta | 89/191.01 |
| 4,197,784 | 4/1980 | Williams | 89/193 |
| 4,244,273 | 1/1981 | Langendorfer, Jr. et al. | 89/193 |

FOREIGN PATENT DOCUMENTS

| | | | |
|---|---|---|---|
| 615019 | 12/1948 | United Kingdom | 89/193 |

*Primary Examiner*—Stephen C. Bentley
*Attorney, Agent, or Firm*—James F. Duffy

[57] ABSTRACT

In an automatic weapon system such as the AR-15/M-16, the passage of propellant gas-carried heat, powder residues, and dirt to the bolt carrier and the upper receiver of the weapon is eliminated. The standard recoil spring housed in the buttstock of the weapon can be eliminated to produce a weapon with a folding stock or a machine pistol. Propelling gasses drive a piston which in turn drives a piston rod which is integrally coupled with the carrier key of the weapon. There is no relative movement between the rod and the carrier key. Therefore, no impact is delivered by the rod to the carrier. Longer carrier life is assured. The original recoil spring can be eliminated by a recoil spring on the piston rod. The ability to vary the volume of the gas chamber in which the piston is driven permits control of the firing rate of the weapon. A further enhancement permits the total blockage of propellant gasses from the gas cylinder so that the weapon may only be fired in a single action, single shot mode.

14 Claims, 3 Drawing Sheets

RECOIL GAS SYSTEM FOR RIFLE

BACKGROUND

1. Technical Field of the Invention

The invention relates to improvements in the direct drive gas system used on the AR-15/M-16 rifle, generally referred to hereinafter simply as the M-16. Further, the invention relates to a system which permits the elimination of the standard recoil spring of the rifle so as to permit the rifle's use with a folding stock or as a machine pistol.

2. Prior Background Art

Although the M-16 system has received much criticism since its introduction in 1963, its design has been modified and enhanced to the point of functional reliability. The AR-15/M-16 has provided excellent service in the past, and is available to do so again. However, more so than many other weapon systems, "functional reliability" of the M-16 system depends on proper maintenance of the weapon.

By its very nature, the M-16 is a filthy weapon. Hot, high pressure gasses, carrying powder residues and dirt, are vented to the upper receiver to drive the bolt rearward, eject a used casing, and chamber a new round. The heat and accumulating particulate matter soon cause lubrication breakdown and sufficient fouling of the upper receiver to produce weapon failure unless a proper, stringent, maintenance regimen is adhered to.

Additionally, in a weaponry world of machine pistols, and rifles with folding stocks, the AR-15/M-16 is a relatively long weapon. Attempts to reduce the overall length have met with very limited success because the weapon's recoil spring is housed in the stock.

Objectives of the present invention are to clean up the M-16, make it less susceptible to fouling, and less dependent upon stringent maintenance practices. This will improve its reliability as a military weapon. A further objective of the invention is to effectively and efficiently enable the use of the weapon with a folding stock or as a machine pistol.

SUMMARY DESCRIPTION OF THE INVENTION

The invention is an automatic weapon which has an upper receiver for housing a bolt carrier which carries a bolt that chambers a round of ammunition for firing and which ejects the spent casing after firing. There is a barrel down which a projectile and its propelling gasses travel. The barrel has a vent for venting a portion of the propelling gasses from the barrel. A gas tube communicates a portion of propelling gasses from the vent to a carrier key on the bolt carrier. The gasses pass through the carrier key and drive the bolt carrier against the restraint of a recoil spring housed in a buttstock affixed to the upper receiver. A spent casing is then ejected and a new round is chambered. The gasses carry heat, powder residues and dirt into the bolt carrier and the upper receiver.

With the improvement, the carrier and the upper receiver are isolated and maintained free of the heat, powder residues and dirt carried by the gasses. A rod has a first end integrally coupled to the carrier key and inhibits passage of gasses into and through the carrier key and bolt carrier. The integral coupling of the rod and the carrier key prevents any impact shock between the rod and the carrier key. The rod has a second end inserted into the gas tube.

A piston is affixed to the second end of the rod and driven by the gasses to traverse the gas tube, driving the rod, in turn, to move the carrier key and the bolt carrier against the recoil spring. This causes the ejection of a spent casing and the chambering of a new round.

A substitute recoil spring is mounted on the piston rod to be stressed by movement of the piston driven by the gasses. The substituted recoil spring is a replacement for the recoil spring originally housed in the buttstock. The substitute recoil spring is the means for returning the piston and the bolt carrier, and causing the chambering of a new round.

There are means coupled to the gas tube for selectedly varying the volume of the gas tube. The rate of automatic fire of the weapon is increased as the volume is reduced, and decreased as the volume is enlarged.

There are also means coupled to the gas vent for selectedly opening and closing the vent whereby, the vent being open, the weapon fires automatically, the vent being closed, the weapon fires as a single action weapon.

The gas tube into which the second end of the rod is inserted and along which tube the piston traverses, is a substitute, replacement for the original gas tube of the weapon. It is a gas cylinder adapted for housing the piston and piston rod.

In a presently preferred embodiment the system includes a first, substitute, replacement bolt carrier having a length selectedly reduced with respect to the length of the original bolt carrier of the weapon. In this manner, the rearward displacement of the first, substitute, replacement bolt carrier outside the upper receiver is selectedly reduced relative to that of the original bolt carrier.

A folding buttstock replacement for the buttstock originally required to house the weapon's recoil spring is preferred.

In an alternative embodiment a second, substitute, replacement bolt carrier has a length selectedly reduced with respect to the length of the original bolt carrier of the weapon so that rearward displacement of the second, substitute, replacement bolt carrier is restricted to the interior of the upper receiver of the weapon. This alternative embodiment includes a modified trip sear replacement for the original trip sear of the weapon. The modified trip sear has an extension tang for actuation by the auto-firing timing edge on the second substitute, replacement bolt carrier. No buttstock is required, so there is disclosed an upper receiver closure terminating the upper receiver as replacement for the original buttstock.

Also taught herein is an improved gas driven automatic weapon produced from the original weapon by the process of:

integrally coupling a first end of a piston rod to the carrier key of the original weapon so that the rod and the carrier key move together free of relative motion between them;

affixing a piston to a second end of the piston rod;

inserting the piston and piston rod into a gas tube mounted on the barrel of the original weapon, the gas tube being coupled to a vent in the barrel for venting projectile propulsion gasses from the barrel into the gas tube; and using the gasses, vented into the gas tube, to drive the piston along the gas tube to drive, in turn, the piston rod and the carrier key so as to move the bolt carrier of the original weapon to the rear of the weapon.

The improved gas-driven automatic weapon can be produced by the further steps of:

removing the buttstock-housed recoil spring from the original weapon;

providing a substitute recoil spring; and housing the substitute recoil spring in the gas tube to be stressed by the piston when the gasses drive the piston along the tube, the substitute recoil spring thereafter returning the piston, piston rod, carrier key and bolt carrier to their forward positions in the original weapon.

Additional steps in producing the improved gas-driven automatic weapon may include:

inserting a rotatable sleeve within the gas tube;

providing a sleeve vent in the sleeve aligned with the vent which vents the gasses from the barrel into the gas tube so that the weapon still fires as an automatic weapon; and rotating the sleeve to misalign the vents to inhibit the venting of gasses from the barrel to the gas tube to thereby limit the original weapon to single action performance.

Additional improvement of the gas-driven automatic weapon includes the further steps of:

providing means for variably adjusting the volume of the gas tube; and setting the means for variably adjusting the volume of the gas tube to selectedly increase and decrease the volume, whereby the automatic rate of fire of the original weapon is selectedly decreased and increased.

The improved gas-driven automatic weapon is produced by the further steps of:

discarding the buttstock which housed the recoil spring of the original weapon; and selectedly reducing the length of the bolt carrier of the original weapon to selectedly limit the rear most position within the original weapon occupied at any time by any portion of the bolt carrier;

attaching at least one of a short stock and upper receiver closure to the original weapon.

DETAILS OF BEST MODE FOR CARRYING OUT THE INVENTION

Figure 1:
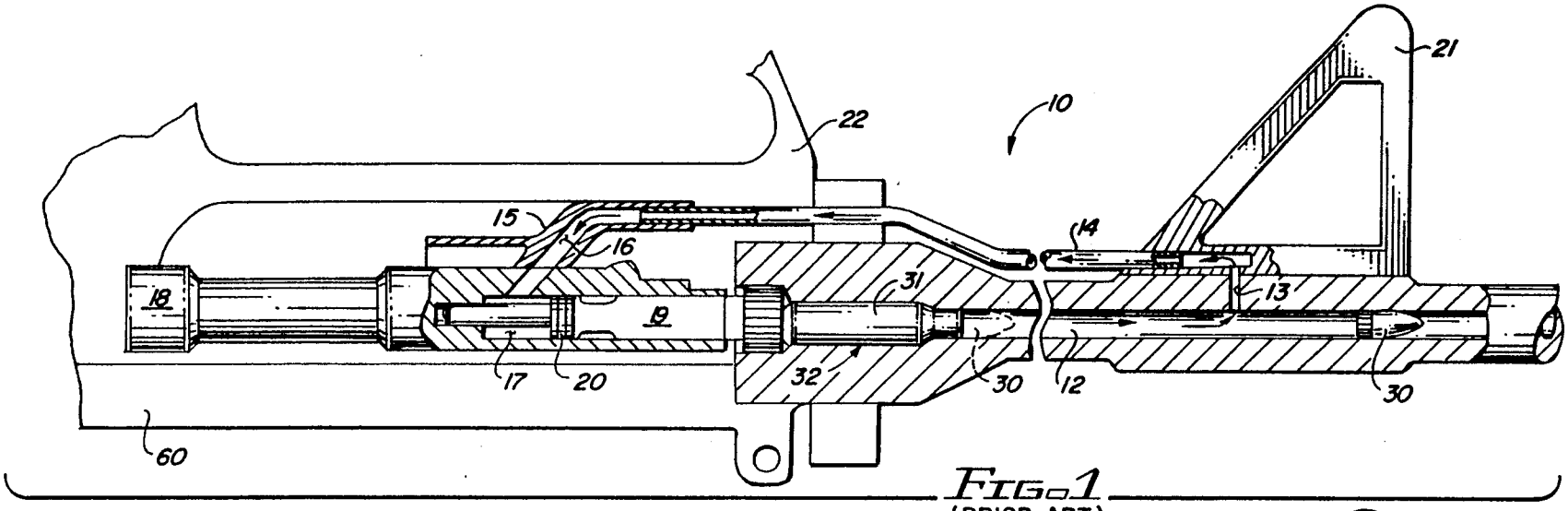
FIG. 1 (PRIOR ART)
FIG. 1 is a cross-sectional view of a portion of the prior art direct gas driven system of the M-16 weapon.

For purposes of promoting an understanding of the principles of the invention, reference will now be made to the embodiments illustrated in the drawings and specific language will be used to describe same. It will nevertheless be understood that no limitation of the scope of the invention is thereby intended. Alterations and modifications of the illustrated device are contemplated, as are such further applications of the principles of the invention as would normally occur to one skilled in the art to which the invention pertains.

A portion of the direct gas driven system of a prior art M-16 weapon is illustrated in cross-section in FIG. 1. The weapon 10 has a barrel 11 and a bore 12 through which projectiles 30 travel the length of barrel 11.

When a chambered round 32 is fired, the explosive materials within casing 31 ignite, causing the explosive expansion of gases which propel projectile 30 along the bore 12 of barrel 11. Most of these gases, indicated by arrows, will exit the barrel with the projectile 30. However, a portion of these gases is vented through vent 13 into gas tube 14. The end of gas tube 14 is slip coupled into carrier key bore 16 in carrier key 15. The gases travel through carrier key bore 16 into chamber 17 of bolt carrier 18, toward the left of the illustration of FIG. 1.

The gases which enter bolt carrier chamber 17 are momentarily entrapped there by gas rings 20 on bolt 19. The rapid advance of gases from gas tube 14 through carrier key 15 into chamber 17 drives bolt carrier 18 to the rear, disengaging carrier key 15 from gas tube 14, camming bolt 19 open and moving it to the rear with carrier 18. When carrier key 15 disengages from gas tube 14, hot gasses and residues spew from gas tube 14 into the weapon's upper receiver chamber 60 which requires frequent, regular cleaning.

In moving to the rear, carrier 18 compresses a recoil spring 63 which is housed in the buttstock of weapon 10 and not illustrated in FIG. 1. (But see FIG. 4.) This recoil spring returns carrier 18 and a newly chambered round 32 to the home position shown in FIG. 1. In this position, gas tube 14 is once again slip coupled to bore 16 of carrier key 15. The weapon is ready to be fired once more.

In the action just described, gases traveling down gas tube 14 and into bolt carrier chamber 17 bring heat, powder residues, and dirt into chamber 17, heating carrier 18 and bolt 19 and fouling both chamber 17 and bolt 19. Frequent cleaning is required to assure the proper functional status of weapon 10 utilizing the prior art, direct gas system.

The improvement taught herein provides a gas cylinder with piston and piston rod. This arrangement utilizes propulsion gasses to drive bolt carrier 18 while eliminating entry of hot propellant gasses and fouling residues from the upper receiver chamber 60 of the weapon. See FIG. 2. As with the prior art, propelling gasses will be drawn from bore 12 via gas vent 13. The gasses enter recoil gas cylinder 42 where they act on piston 44. Piston 44 is affixed to piston rod 43. Rod 43 is thread coupled at 47 to modified carrier key 46. Modified carrier key 46 differs from the prior art carrier key 15 of FIG. 1 in that the gas carrying bore 16 for carrying gas into chamber 17 is no longer required or utilized, and means for making threaded coupling with rod 43 are provided at 47. The threaded coupling at 47 of piston rod 43 with modified carrier key 46 couples the two as an integral unit and eliminates repeated shock impact such as would be present if piston rod 43 were not integrally affixed to modified carrier key 46.

The movement of piston rod 43 is guided by passage through guide 48. Piston rod guide 48 is removably coupled to the weapon's upper receiver housing 22 by means of retainer clip 49.

Figure 2:
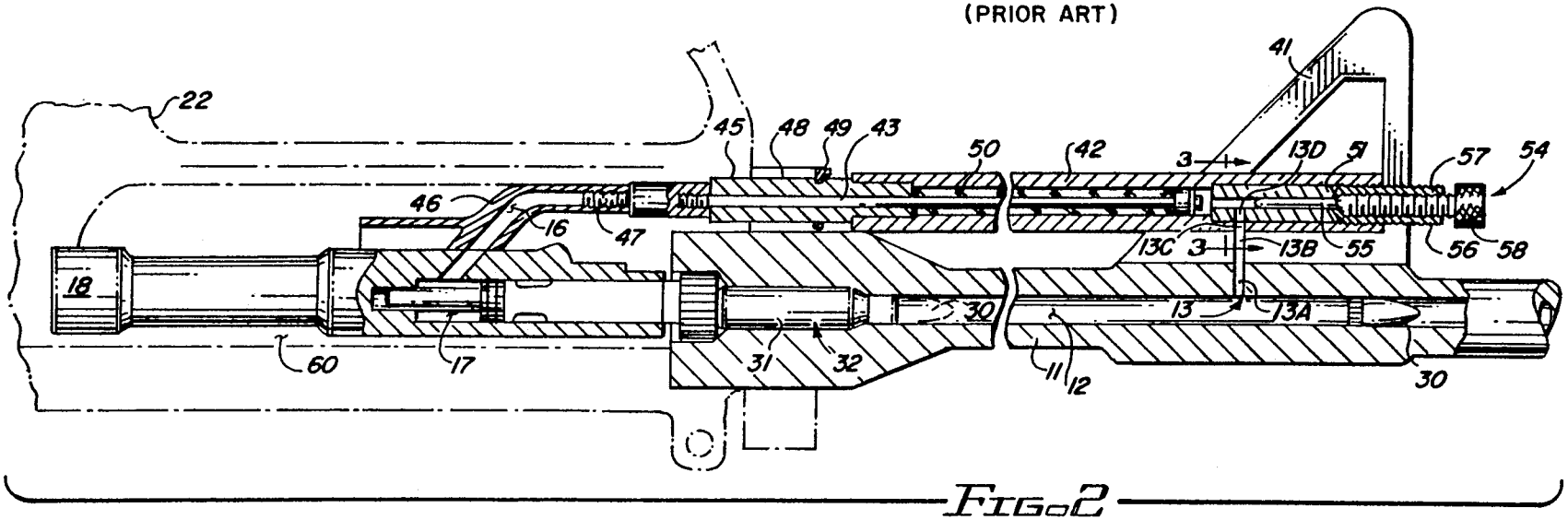
FIG. 2 is a cross-sectional view of the improved gas driven recoil system for the AR-15/M-16 weapon.

Omitting, for the moment, certain other improvements which are illustrated in FIG. 2, most notably recoil spring 50, disclosure of the operation of the gas actuated system utilizing the elements discussed immediately above will be undertaken at this point.

Exhaust gasses exiting bore 12 of barrel 11 via gas vent 13 will expand into recoil gas cylinder 42. These gasses drive piston 44 and its attached piston rod 43 to the left of the illustration of FIG. 2. This movement of piston rod 43 to the left of FIG. 2 constitutes a rearward movement of rod 43 which, by reason of its threaded coupling at 47 to modified carrier key 46, carries carrier key 46 and bolt carrier 18 rearward as well. This then cams bolt 19 open and moves it to the rear also.

As this point, the prior art recoil spring 63 in the buttstock of the weapon (See FIG. 4) would normally impel bolt carrier 18 forward to carry a new round 32 into position for firing. The weapon would be improved and reliably functional in this state. However, it is the presence of the prior art recoil spring 63 in the buttstock of the prior art weapon which prevents an effective reduction in the length of the weapon. The teachings herein propose the elimination of the prior art recoil spring and the buttstock housing for that spring. This is achieved by the addition of recoil spring 50 to gas cylinder 42. Recoil Spring 50 is carried by piston rod 43 and stressed into compression by the motion of piston 44 as that piston is driven to the left by the expansion of propulsion gasses within gas cylinder 42.

When piston 44 moves to the left of the illustration of FIG. 2, recoil spring 50 will be stressed into compression, as just noted. On dissipation of the energizing gasses, spring 50 will return to its original length drawing piston 44 with carrier key 46 to the right. This, in turn, draws bolt carrier 18 and a new round 32 into position within the weapon.

Recoil spring 50 within recoil gas cylinder 42 thus serves the function originally performed by the prior art recoil spring in the buttstock of the weapon. Further, recoil spring 50 remains partially stressed so that it provides a modicum of pre-loading on piston 44. This pre-loading must be overcome before piston rod 43 moves carrier key 46. The pre-loading of piston 44 by spring 50 and the integral, coupling of carrier key 46 and piston rod 43 combine to further reduce the possibility of shock impact being delivered to carrier key 46 by piston rod 43.

It should again be noted that to this point the improvement does not rely upon the presence of a recoil spring 50 within gas cylinder 42. Without spring 50 the movement of piston rod 43 to the left of the illustration of FIG. 2 will draw carrier key 46 and bolt carrier 18 to the rear of the weapon, to the left of FIG. 2. The original recoil spring 63 then returns the bolt carrier assembly and a new round into position for firing, and repositions piston 44 for later movement upon impingement of propulsion gasses into cylinder 42.

Because no propulsion gasses or residues carried by those gasses are communicated to upper receiver 60, the bolt and receiver assembly remain relatively cool and clean. Without the high temperature gasses and the fouling residues carried by them, as experienced with the prior art gas system, the instant system is more functionally reliable and not so dependent upon stringent maintenance routines.

Because piston rod 43 and modified carrier key 46 are fixedly coupled together by means of thread couplings at 47, there is no relative motion between piston rod 43 and carrier key 46. Therefore, there is no impact battering of carrier key 46 upon gas driven movement of piston rod 43. The elimination of battering contact between these two elements assures a longer functional life for the system.

As just noted, the system without recoil spring 50 represents an improvement over the prior art gas driven system. However, incorporation of recoil spring 50 within gas cylinder 42 makes it possible to eliminate the prior art recoil spring 63 housed within the buttstock 62 of the weapon. (See FIG. 4.) Without the necessity to house a recoil spring within the buttstock, minor modifications may be added to the weapon which permit the use of the weapon as a machine pistol or a rifle with a folding stock.

This concept will be discussed in further detail later. For now, further disclosure permitting additional improved operation of the gas driven system will be had. This further discussion will disclose a simple mechanism for converting the weapon from a full automatic to a single shot device, as well as means for varying the automatic firing rate of the weapon. Both enhancements are available because of the presence of recoil gas cylinder 42.

Recoil gas cylinder 42 is affixed to modified front sight base 41. The sight base is modified by the removal of gas tube 14 and the addition of recoil gas cylinder 42. A sleeve 51 is inserted into bore 53 of gas cylinder 42. Sleeve 51 is rotatively coupled to gas cylinder 52 and modified sight base 41. Gasses venting from rifle bore 12 through gas vent 13 expand into bore 52 of sleeve 51 and bore 53 of gas cylinder 42. The volume presented by bores 52 and 53, into which the propulsion gasses from gas vent 13 expands, determines the firing rate of the weapon. When the combined volume of bores 52 and 53 is relatively small, gasses entering cylinder 42 from gas vent 13 will actuate piston 44 and piston rod 43 at a relatively rapid rate. This rapid movement is transmitted to bolt carrier key 46 to cam bolt 19 open and move it to the rear of the weapon, to the left of FIG. 2

If the combined volume of bores 52 and 53 is relatively large, it will take longer for the expanding gasses to fill the volume and exercise piston 44. Therefore, bolt 19 will be cammed open and moved to the rear of the weapon at a lower rate of speed, thereby producing a reduced firing rate.

To permit a controlled variation in the combined volume of bores 52 and 53, bore 52 of sleeve 51 is closed by means of rate of fire screw 54. Rate of fire screw 54 includes a bore filling shaft 55 and a threaded shank 56. Threaded shank 56 is threadedly coupled to sleeve 51 at 57. The head 58 of screw 54 may be finger rotated to adjust the depth of penetration of bore filling shank 55 within bore 52. Thus, turning screwhead 58 so as to drive shaft 55 into bore 52 reduces the total volume of bores 52 and 53, and thus increases the rate of fire of the weapon. Conversely, turning head 58 or screw 54 so as to withdraw shaft 55 from bore 52 increases the total volume of bores 52 and 53 and reduces the rate of fire of the weapon.

Recall that gasses are vented from bore 12 of rifle barrel 11 via gas vent 13. Gas vent 13 is made up of several successive sections. The first section 13A passes through barrel 11. The second section 13B passes through a portion of front sight base 41. A third section 13C passes through the wall of cylinder 42. The final section 13D passes through sleeve 51 and opens into bore 52 of that sleeve.

Remember that sleeve 51 is rotatingly coupled to cylinder 42 and front sight base 41. In its nominal position, sleeve 51 reposes within cylinder 42 such that its section 13D of vent 13 lines up with the remaining three sections 13A–C. Gas will flow unimpeded through vent sections 13A–D and into bore 52 of sleeve 51. The effect of rotating sleeve 51 within cylinder 42 is best seen in the illustration of FIG. 3, which is a cross-sectional view taken along the line 3—3 of FIG. 2.

Figure 3:
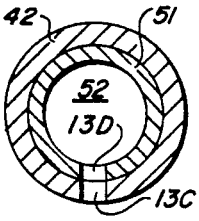
FIG. 3 is a cross-sectional view taken along line 3—3 of FIG. 2 showing a through passage for propulsion gasses through successive gas vents into the bore of the gas cylinder.
Figure 3A:
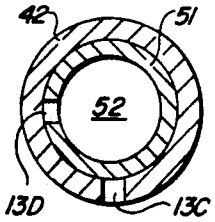
FIG. 3A is the same view as FIG. 3 except that the inner sleeve has been rotated to prevent gas flow through the gas vents and into the bore.

In the cross-sectional view of FIG. 3 sleeve 51 is shown disposed within gas cylinder 42. Gas vent segments 13C and 13D are aligned so that gas entering vent 13 will expand into bore 52 of sleeve 51. However, upon rotation of sleeve 51 one-quarter turn, as illustrated in FIG. 3A, the vent sections 13C and 13D are no longer aligned. Now gas entering vent 13 from rifle bore 12 will be blocked, since these vent sections are not aligned. No gas will enter into bore 52 of sleeve 51. With no gas entering bore 52, the weapon will perform as a single action rifle.

The improvement described offers a choice. Actually, several choices are offered. The original, prior art, recoil spring may be retained. In this event, there is no need to provide gas cylinder recoil spring 50. Alternatively, the prior art recoil spring may be eliminated and the return of the bolt and bolt carrier actuated in response to the recoil spring 50 within recoil gas cylinder 52.

Figure 4:
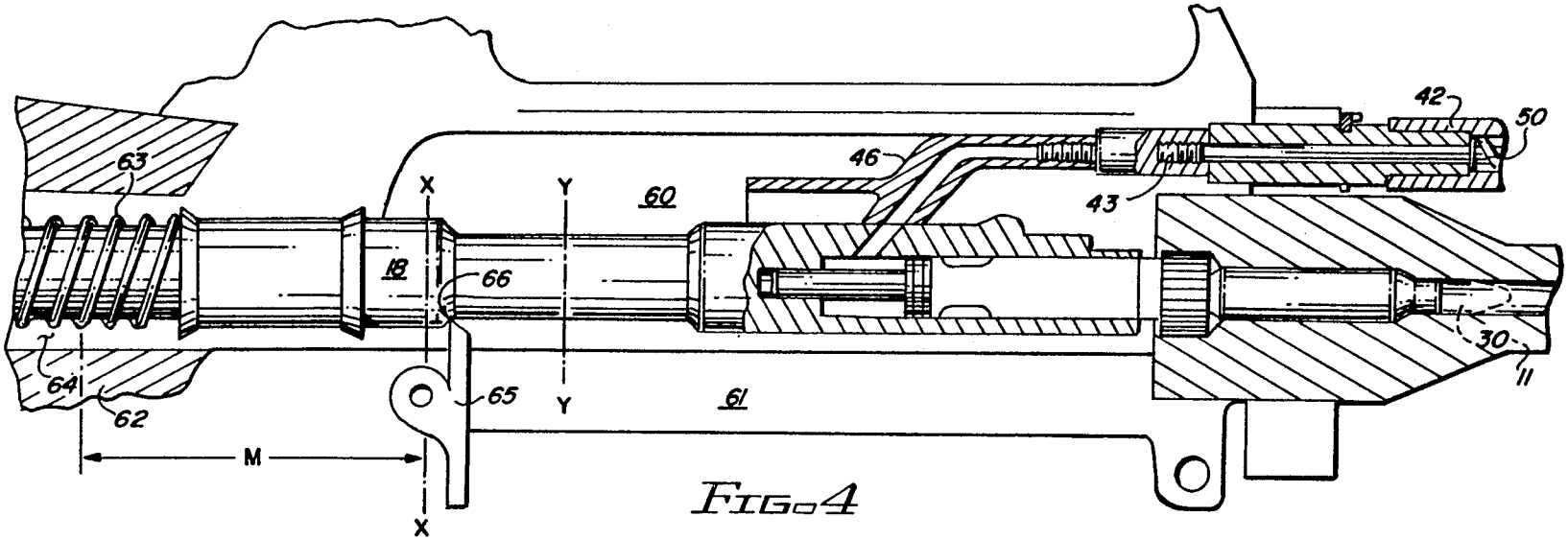
FIG. 4 is a cross-sectional view of a portion of the weapon illustrating components in the upper and lower receiver and in the buttstock of the weapon. Lines at which the bolt carrier may be cut for purposes of shortening the carrier are indicated.

In the event that the prior recoil spring is eliminated, further choices remain to be made. FIG. 4 illustrates a simplified cross-sectional view of a portion of the M-16 weapon system to which the improved gas driven system has been installed including the gas cylinder recoil spring 50. With spring 50 functioning, the prior art recoil spring 63 housed within buttstock 62 can be eliminated. The elimination of prior art recoil spring 63, in and of itself, provides little opportunity for reducing the overall length of the weapon since bolt carrier 18 will still be driven rearward into the spring recess well 64 in buttstock 62. In order to substantially reduce the length of the M-16 weapon, bolt carrier 18 will itself have to be reduced in length.

If the decision is made to reduce the length of bolt carrier 18, further choices must be made as well.

If a shorter weapon is to be achieved with minimal changes, bolt carrier 18 may be cut along line X—X of FIG. 4. Cutting carrier 18 in the vicinity of line X—X leaves the auto-firing timing edge 66 intact for actuating trip sear 65. Cutting of carrier 18 along line X—X offers ample opportunity for the elimination of buttstock 62 and the reduction of the overall length of the weapon. However, carrier 18 will still move to the rear of the weapon and extend outside of the upper receiver 60. This movement is indicated by the dimension M in FIG. 4. If buttstock 62 is eliminated under these circumstances a short end cap (71, FIG. 8) will be required to encompass that short portion of bolt carrier 18 which will exit from upper receiver 60.

If it is desired that the rearward movement of bolt carrier 18 shall carry no portion of the carrier outside of upper receiver 60, carrier 18 may be cut along a line indicated Y—Y in FIG. 4. Unfortunately, the cutting of bolt carrier 18 along Y—Y eliminates the original auto-firing timing edge 66. A new auto-firing timing edge 66A must be provided. See FIG. 5.

Bolt carrier 18 is housed and functions within the confines of upper receiver 60. Trip sear 65 and other components of the firing mechanism, not shown, are housed within the lower receiver 61. As seen is FIGS. 4 and 5, trip sear 65 extends upwards from the lower receiver 61 into the upper receiver 60 to make contact with the auto-fire timing edge 66 of bolt carrier 18. As FIG. 4 clearly indicates, the cutting of bolt carrier 18 along line Y-Y removes all contact between carrier 18 and trip sear 65. So, to make the weapon functional with so shortened a carrier 18, there is not only the requirement of providing a new auto-firing timing edge 66A but also a means for extending the trip sear 65 to bring it into actuating contact with new auto-firing timing edge 66A. First, the method whereby a new auto-firing timing edge 66A is achieved will be disclosed.

When bolt carrier 18 is cut along line Y—Y a relatively flat smooth edge results. This situation is remedied by welding a small projection 67 at the base of the shortened bolt carrier 18. Projection 67 provides a leading edge 66A which serves as the new auto-firing timing edge hereafter referred by the reference 66A.

So that the new auto-firing timing edge 66A may actuate trip sear 65, an extension tang 68 is welded to trip sear 65 at 69. Extension tang 68 extends the point of contact between bolt carrier 18 and trip sear 65 so that the weapon will operate with the shortened bolt carrier.

The shortened bolt carrier 18, cut along line Y—Y, will extend to the rear of the weapon to a position approximating that shown in phantom outline. Bolt carrier 18 remains within upper receiver 60. No portion of carrier 18 extends outside the upper receiver. The overall effect of shortening carrier 18 will now be considered.

The teachings herein provide the opportunity for dramatically changing the M-16 weapon system in a manner which not only enhances the improvement of the weapon, but conveniently reduces its size so that the weapon may be readily fired from and moved into and out of small openings such as personnel hatchways in tanks and sea-going vessels and the like.

Figure 6:
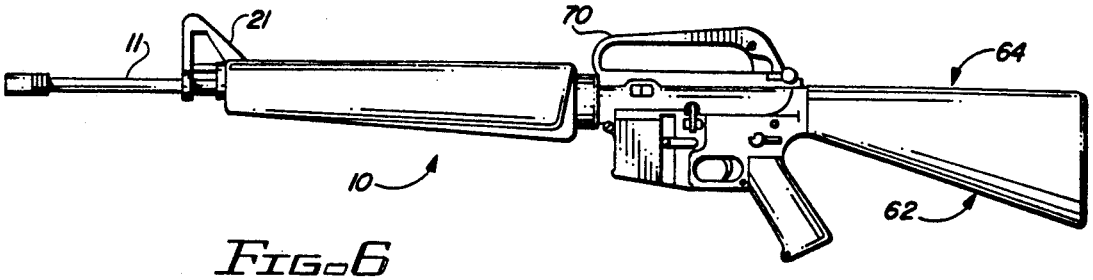
FIG. 6 (PRIOR ART)
FIG. 6 illustrates a prior art M-16 weapon system.

An M-16 weapon 10 is illustrated in FIG. 6 and includes the rear sight carrier 70. The outline of the rear spring recess well 64 is visible in buttstock 62. It is in spring recess well 64 that the prior art recoil spring 63 is housed.

Figure 7:
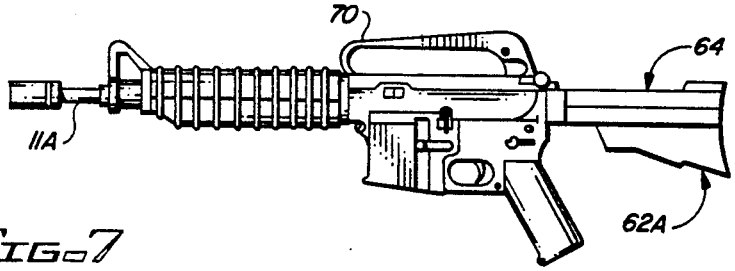
FIG. 7 (PRIOR ART)
FIG. 7 illustrates a prior art weapon system with a shortened stock.

In the weapons system of FIG. 7, again prior art, buttstock 62 has been replaced with a shortened buttstock 62A. The reduction in length of 62A is limited by the necessity for maintaining recoil spring recess well 64. So long as the prior art recoil spring 63 is required, the ability to reduce the buttstock is generally limited to that illustrated in FIG. 7.

Figure 8:
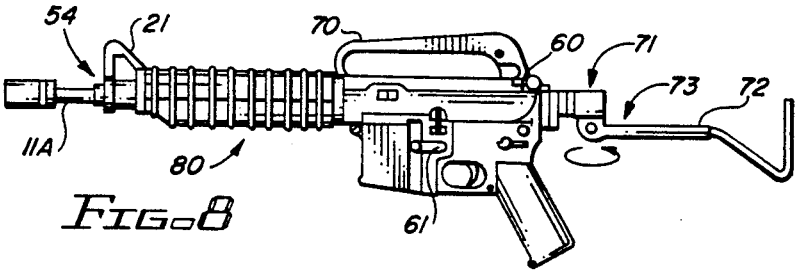
FIG. 8 illustrates a weapon system in which the invention is utilized such that the standard recoil spring has been eliminated, the weapon has been shortened, and a folding stock attached.

A weapon utilizing the teachings set forth herein is shown in FIG. 8. In this weapon, bolt carrier 18 has been cut along line X—X in accord with the discussion set forth with reference to FIGS. 4 and 5. When bolt carrier 18 is cut along line XX of FIG. 4, the carrier will move a distance M which means it will move outside of the upper receiver 60. Thus, a short carrier well 71 must be positioned at the rear of the receiver 60 in order to receive bolt carrier 18 in its travel to the rear.

To carrier well 71 has been pivotally fastened a folding stock 72. Stock 72 folds pivotally about pivot 73. In the folded position, stock 72 lies flat alongside upper and lower receivers 60 and 61. This improved weapon system 80, with its drastically reduced length, may be employed as a machine pistol when stock 72 is in its folded position and as a rifle when folded stock 72 is extended in the manner indicated in FIG. 8.

Figure 5:
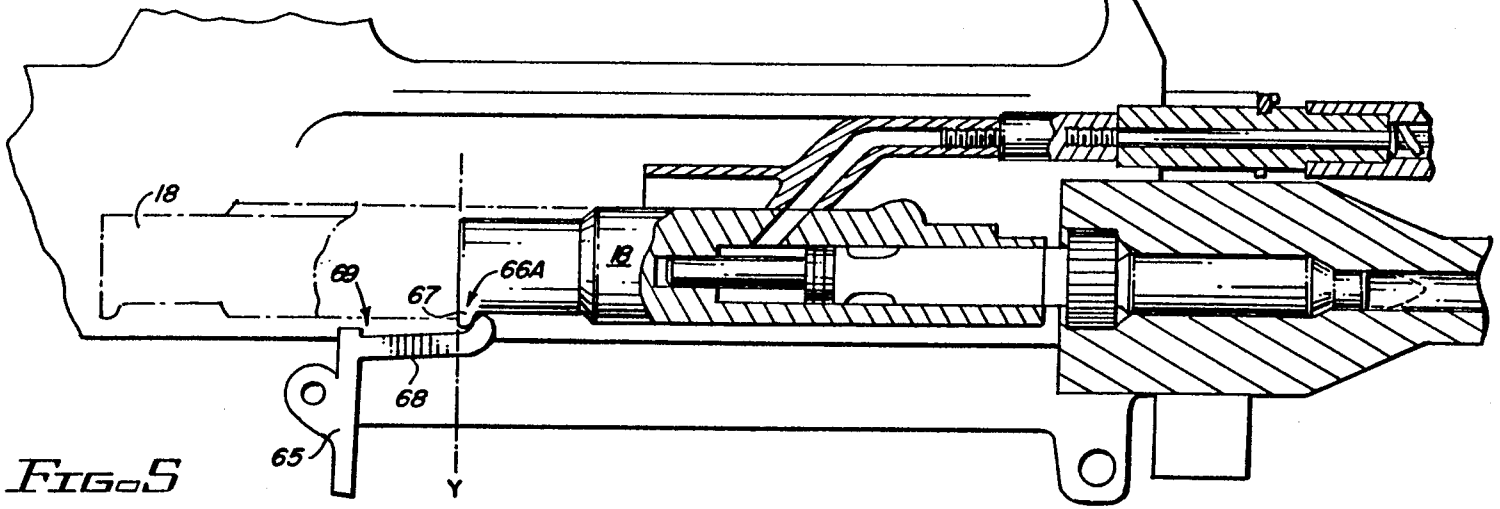
FIG. 5 is a cross-sectional view similar to that of FIG. 4 showing the manner in which the sear mechanism is modified when the bolt carrier is so shortened that it never exits from the upper receiver in the course of its travel.
Figure 9:
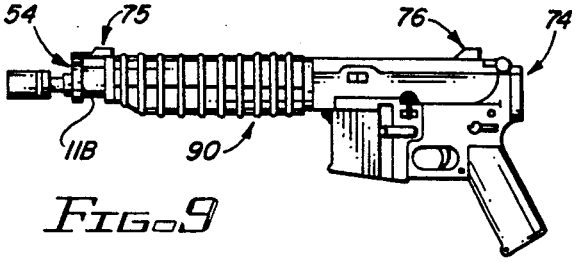
FIG. 9 illustrates the machine pistol which results from practice of the invention taught herein. The upper receiver of the weapon is capped; and the bolt carrier never travels past the rear of the upper receiver.

The automatic machine pistol 90 shown in FIG. 9 results when the invention is practiced by cutting bolt carrier 18 along line Y—Y of FIGS. 4 and 5. As FIG. 5 indicates, carrier 18 will travel to the rear of the weapon but will not extend outside of upper receiver 60. An upper receiver closure 74 is utilized to close the former carrier exit. Further modifications have also been made. The barrel 11B is shorter than that illustrated with the other weapons in FIGS. 6–8. The front sight base 21 and the rear sight carrier 70 have been removed from weapon 90 of FIG. 9. Front sight 75 and rear sight 76 have been placed directly on the weapon to further reduce its profile.

It should be noted that in the folding stock version of the weapon, weapon 80, the front sight base 21 and the rear sight carrier 70 could also have been removed the front and rear sight located directly on the weapon.

In both FIGS. 8 and 9 the rate of fire screw 54 is visible at the front end of the weapon, above the barrel.

It should be noted, in the interest of full disclosure, that the M-16 has a charging handle for manually drawing bolt carrier 18 to the rear of upper receiver 60. A track, interior of upper receiver housing 22, guides travel of the charging handle. This track does not run the full length of upper receiver 60. In order to practice the invention herein, to permit assembly of parts in the most efficient manner, this track should be extended to exit upper receiver housing 22 at the rear of upper receiver 60. Then the bolt carrier 18 carrier key 15, piston rod 43, piston 44, and the charge handle may be inserted as an assembly into upper receiver 60.

What has been disclosed is an improvement in an automatic weapon system such as the AR-15/M-16. The passage of propellant gas-carried heat, powder residues, and dirt to the bolt carrier and the upper receiver of the weapon is eliminated. The weapon thus requires a less stringent maintenance program to remain fully functional. The standard recoil spring housed in the buttstock of the weapon can be eliminated so that a weapon with a folding stock can be produced or a machine pistol derived. The improvement uses propelling gasses to drive a piston which in turn drives a piston rod which is integrally coupled with the carrier key of the weapon. Because of the integral coupling between piston rod and the carrier key, there is no relative movement between the rod and the carrier key and, therefore, no impact is delivered by the rod to the carrier. Longer carrier life is thus assured. A recoil spring on the piston rod substitutes for the prior art recoil spring and allows elimination of the original recoil spring. The ability to vary the volume of the gas chamber in which the piston is driven permits control of the firing rate of the weapon. A further enhancement permits the total blockage of propellant gasses from the gas cylinder so that the weapon may be only fired in a single action, single shot mode.

Those skilled in the art will conceive of other embodiments of the invention which may be drawn from the disclosure herein. To the extent that such other embodiments are so drawn, it is intended that they shall fall within the ambit of protection provided by the claims herein.

Having described the invention in the foregoing description and drawings in such clear and concise manner that those skilled in the art may readily understand and practice the invention, That which is claimed is:

1. In an original automatic weapon which has an upper receiver interiorly housing an original bolt carrie which carries a bolt which chambers a round of ammunition for firing and which ejects a spent casing after firing; said original bolt carrier having an auto-firing timing edge for actuating an original trip sear housed partially in a lower receiver or said weapon; a barrel down which a projectile and its propelling gasses travel; a vent for venting a portion of said propelling gasses from said barrel; a gas tube for communicating said portion of propelling gasses from said vent to a carrier key on said original bolt carrier, said gasses passing through said carrier key and driving said original bolt carrier against the restraint of an original recoil spring; an original buttstock affixed to said upper receiver; whereby a spent casing is ejected and a new round is chambered, said gasses carrying heat, powder residues and dirt into said original bolt carrier and said upper receiver; the improvement modifying said original weapon wherein said carrier and said upper receiver are isolated and maintained free of said heat, powder residues and dirt carried by said gasses, said modifying improvement comprising:

a rod having a first end integrally coupled to said carrier key and inhibiting passage of said gasses into and through said carrier key and bolt carrier, the integral coupling of said rod and said carrier key preventing any impact shock between said rod and said carrier key; said rod having a second end inserted into said gas tube;

a piston affixed to said second end of said rod and driven by said gasses to traverse said gas tube, driving said rod, in turn, to move said carrier key and said bolt carrier against said recoil spring to cause the ejection of a spent casing and the chambering of a new round, a substitute recoil spring mounted on said piston rod to be stressed by movement of said piston driven by said gasses, said substitute recoil spring being a replacement for said original recoil spring which was originally housed in said buttstock, said substitute recoil spring being the means for returning said piston, and said bolt carrier and causing the chambering of a new round, and a first, substitute, replacement bolt carrier having a length selectedly reduced with respect to the length of said original bolt carrier of said original weapon whereby the rearward displacement of said first, substitute, replacement bolt carrier outside said upper receiver is selectedly reduced relative to that of said original bolt carrier, said first, substitute, replacement bolt carrier being a replacement for said original bolt carrier originally carrying said bolt for chambering said round.

2. The improvement of claim 1 further comprising:

means coupled to said gas tube for selectedly varying the volume of said gas tube whereby the rate of automatic fire of said weapon is increased as said volume is reduced and decreased as said volume is enlarged.

3. The improvement of claim 2 further comprising:

means coupled to said gas vent for selectedly opening and closing said vent whereby, said vent being open, said weapon fires automatically, said vent being closed, said weapon fires as a single action weapon.

4. The improvement of claim 3 wherein said gas tube into which said second end of said rod is inserted and along which tube said piston traverses, is a substitute, replacement for the original gas tube of said weapon, being a gas cylinder for housing said piston and piston rod.

5. The improvement of claim 1 further comprising:

means coupled to said gas vent for selectedly opening and closing said vent whereby, said vent being open, said weapon fires automatically, said vent being closed, said weapon fires as a single action weapon.

6. The improvement of claim 1 further comprising a folding buttstock replacement for said original buttstock originally required for housing said weapon's original recoil spring.

7. In an original automatic weapon which has an upper receiver interiorly housing an original bolt carrier which carries a bolt which chambers a round of ammunition for firing and which ejects a spent casing after firing; said original bolt carrier having auto-firing timing edge for actuating an original trip sear housed partially in a lower receiver of said weapon; a barrel down which a projectile and its propelling gasses travel; a vent for venting a portion of said propelling gasses from said barrel; a gas tube for communicating said portion of propelling gasses from said vent to a carrier key on said original bolt carrier, said gasses passing through said carrier key and driving said original bolt carrier against the restraint of an original recoil spring; an original buttstock affixed to said upper receiver; whereby a spent casing is ejected and a new round is chambered, said gasses carrying heat, powder residues and dirt into said original bolt carrier and said upper receiver; the improvement modifying said original weapon wherein said carrier and said upper receiver are isolated and maintained free of said heat, powder residues and dirt carried by said gasses, said modifying improvement comprising:

a rod having a first end integrally coupled to said carrier key and inhibiting passage of said gasses into and through said carrier key and bolt carrier, the integral coupling of said rod and said carrier key preventing any impact shock between said rod and said carrier key; said rod having a second end inserted into said gas tube;

a piston affixed to said second end of said rod and driven by said gasses to traverse said gas tube, driving said rod, in turn, to move said carrier key and said bolt carrier against said recoil spring to cause the ejection of a spent casing and the chambering of a new round, a substitute recoil spring mounted on said piston rod to be stressed by movement of said piston driven by said gasses, said substitute recoil spring being a replacement for said original recoil spring which was originally housed in said buttstock, said substitute recoil spring being the means for returning said piston, and said bolt carrier and causing the chambering of a new round, and a substitute, replacement bolt carrier having a length selectedly reduced with respect to the length of said original bolt carrier of said original weapon whereby rearward displacement of said substitute, replacement bolt carrier is restricted to the interior of said upper receiver of said weapon.

8. The improvement of claim 7 including a modified trip sear replacing said original trip sear of said weapon, said modified trip sear including an extension tang for actuation of said an auto-firing timing edge on said substitute, said substitute, replacement bolt carrier having a said auto-firing edge thereon.

9. The improvement of claim 8 including an upper receiver closure terminating said upper receiver as replacement for said original buttstock.

10. An improved gas driven automatic weapon produced from the original weapon by the process of:

integrally coupling a first end of a piston rod to the carrier key of said original weapon so that said rod and said carrier key move together free of relative motion between them;

affixing a piston to a second end of said piston rod;

inserting said piston and piston rod into a gas tube mounted on the barrel of said original weapon, said gas tube being coupled to a vent in said barrel for venting projectile propulsion gasses from said barrel into said gas tube;

using said gasses, vented into said gas tube to drive said piston along said gas tube to drive, in turn, said piston rod and said carrier key so as to move the bolt carrier of said original weapon to the rear of said weapon;

providing means for variably adjusting the volume of said gas tube; and setting said means for variably adjusting said volume of said gas tube to selectedly increase and decrease said volume, whereby the automatic rate of first of said original weapon is selectedly decreased and increased; and further providing a substitute, replacement bolt carrier mounted on said piston rod and having a length selectedly reduced with respect to the length of the original bolt carrier of said original weapon whereby the rearward displacement of said substitute, replacement bolt carrier receiver is selectedly reduced relative to that of said original bolt carrier, said substitute, replacement bolt carrier replacing said original bolt carrier originally carrying said bolt for chambering said round.

11. The improved gas-driven automatic weapon of claim 10 produced by the further steps of:

removing the buttstock-housed recoil spring from said original weapon;

providing a substitute recoil spring; and housing said substitute recoil spring in said gas tube to be stressed by said piston when said gasses drive said piston along said tube, said substitute recoil spring thereafter returning said piston, piston rod, carrier key and bolt carrier to their forward positions in said original weapon.

12. The improved gas-driven automatic weapon of claim 10 produced by the further steps of:

inserting a rotatable sleeve within said gas tube;

providing a sleeve vent in said sleeve aligned with said vent which vents said gasses from said barrel into said gas tube whereby said original weapon will continue to operate as an automatic weapon; and rotating said sleeve to misalign said vents to inhibit the venting of gasses from said barrel to said gas tube to thereby limit said original weapon to single action performance.

13. The improved gas-driven automatic weapon of claim 10 produced by the further steps of:

discarding the buttstock which housed the recoil spring of said original weapon; and selectedly reducing the length of the bolt carrier of said original weapon to selectedly limit the rear most position within said original weapon occupied at any time by any portion of said bolt carrier;

attaching at least one of a short stock and upper receiver closure to said original weapon.

14. An improved gas driven automatic weapon produced from the original weapon by the process of;

coupling a first end of a piston rod to the original carrier key of said original weapon;

affixing a piston to a second end of said piston rod;

inserting said piston and piston rod into a gas tube;

mounting said gas tube on the barrel of said original weapon coupling said gas tube to an original vent in said barrel for venting projectile propulsion gasses from said barrel into said gas tube;

using said gasses, vented into said gas tube, to drive said piston rod along said gas tube to drive, in turn, said piston rod and said carrier key toward the rear of said weapon;

removing the original buttstock-housed recoil spring from said original weapon.

providing a substitute recoil spring and mounting it on said piston rod;

housing said substitute recoil spring in said gas tube to be stressed by said piston when said gasses drive said piston along said tube, said substituted recoil spring thereafter returning said piston, and piston rod to their forward positions in said original weapon;

removing the original bolt carrier from said original weapon; and replacing said original bolt carrier with a substitute, replacement bolt carrier having a length selectedly reduced with respect to the length of said original bolt carrier so that the rearward displacement of said substitute, replacement carrier is selectedly reduced relative to that of said original bolt carrier.

* * * * *